United States Patent [19]

Jimenez et al.

[11] Patent Number: 4,779,172

[45] Date of Patent: Oct. 18, 1988

[54] DISCO JEWELRY

[76] Inventors: Francisco G. Jimenez, G.P.O. Box 4805, San Juan, P.R. 00936; George Spector, 233 Broadway Rm. 3815, New York, N.Y. 10007

[21] Appl. No.: 150,844

[22] Filed: Feb. 1, 1988

[51] Int. Cl.[4] ..... F21L 15/08

[52] U.S. Cl. ..... 362/104; 362/806

[58] Field of Search ..... 362/103, 104, 253, 800, 362/806

[56] References Cited

U.S. PATENT DOCUMENTS 4,076,976 2/1978 Faiton ..... 362/104
4,093,976 6/1978 Vaagnes ..... 362/104
4,161,018 2/1979 Briggs et al. ..... 362/104

FOREIGN PATENT DOCUMENTS 0160178 5/1983 German Democratic Rep. ..... 362/104
2136673 9/1986 United Kingdom ..... 362/104

*Primary Examiner*—Michael Koczo
*Assistant Examiner*—Sue Hagarman

[57] ABSTRACT

Intermittent illuminated disco jewelry is provided in which the lamp members, flasher, battery and switch are hidden within the disco jewelry and yet function to illuminate intermittently the disco jewelry. The flasher, battery and switch are removable so as to be replaced when needed.

4 Claims, 1 Drawing Sheet

DISCO JEWELRY

BACKGROUND OF THE INVENTION

The instant invention relates generally to illuminated jewelry and more specifically it relates to intermittent illuminated disco jewelry.

Numerous illuminated jewelry have been provided in prior art that are adapted to include battery operated light emitting structures within the jewelry. For example, U.S. Pat. Nos. 2,854,564; 4,271,457 and 4,309,743 all are illustrative of such prior art. While these units may be suitable for the particular purpose to which they address, they would not be as suitable for the purposes of the present invention as heretofore described.

SUMMARY OF THE INVENTION

A primary object of the present invention is to provide intermittent illuminated disco jewelry that will overcome the shortcomings of the prior art devices.

Another object is to provide intermittent illuminated disco jewelry in which the lamp members, flasher, battery and switch are constructed within the disco jewelry to be hidden and yet function to illuminate intermittently the disco jewelry.

An additional object is to provide intermittent illuminated disco jewelry whereby the flasher, battery and switch are removable therefrom so as to be replaceable when needed.

A further object is to provide intermittent illuminated disco jewelry that is simple and easy to use.

A still further object is to provide intermittent illuminated disco jewelry that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
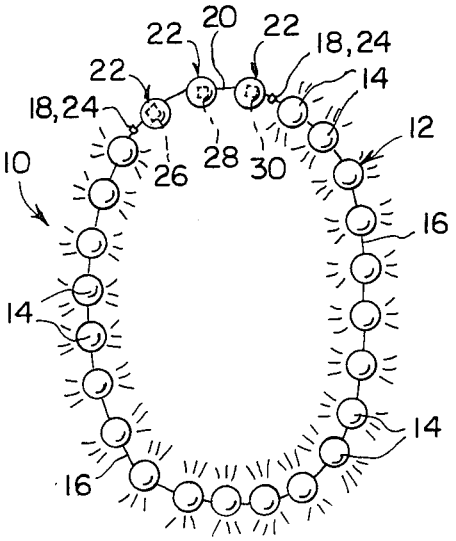
FIG. 1 is a front elevational view of the invention as a necklace or bracelet.
Figure 4:
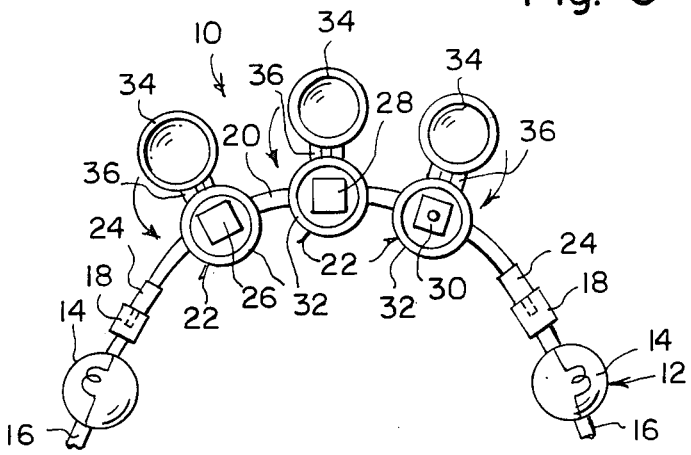
FIG. 4 is an enlarged detail view of the invention shown in FIG. 1, showing the bead-like receptacles open so that the flasher, battery and switch can be removed and replaced when needed.

Turning now descriptively to the drawings, in which similar reference characters denote similar elements throughout the several views, FIGS. 1 and 4 illustrate a piece of intermittent illuminated disco jewelry 10 in the form of a necklace or bracelet 12 consisting of a plurality of bead-like lamp members 14. An elongated wire 16 is strung through all of the bead-like lamp members 14 to electrically connect each of the bead-like lamp members 14 together. A socket 18 is located on each distal end of the elongated wire 16. A short wire 20 is strung through three bead-like receptacles 22 to electrically connect all of the bead-like receptacles 22 together. A jack 24 is located on each distal end of the short wire 20 to electrically mate with one of the sockets 18 on the elongated wire 16. A flasher 26, a battery 28 and a switch 30 each electrically plugs into one of the bead-like receptacles 22 so that when the circuit is made complete and the switch 30 is turned on the disco jewelry 10 will illuminate intermittently.

Each of the bead-like receptacles ZZ is split into two halves 32 and 34 with a hinge 36 therebetween. When the flasher 26, the battery 28 and the switch 30 is electrically plugged into the respective receptacle 22 in one of the two halves 32 the other half 34 can be closed over for concealment.

Figure 2:
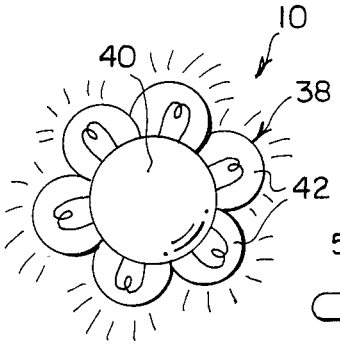
FIG. 2 is a top elevational view of the invention as an earring or pendant.
Figure 5:
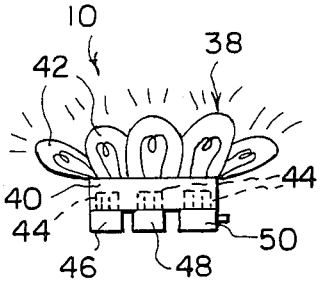
FIG. 5 is a side view of the invention in FIG. 2 showing the flasher, battery and switch plugged into receptacles in rear of the ornamented face.

FIGS. 2 and 5 illustrate the piece of disco jewelry 10 in the form of an earring or pendant 38 consistng of an ornamented face 40 that has a plurality of flower pedal-like lamp members 42 thereon electrically connected to each other. Three receptacles 44 arranged into rear of the ornamented face 40 are electrically connected to the lamp members 42. A flasher 46, a battery 48 and a switch 50 each electrically plugs into one of the receptacles 44 so that when circuit is made complete and the switch 48 is turned on, the disco jewelry 10 will illuminate intermittently.

Figure 3:
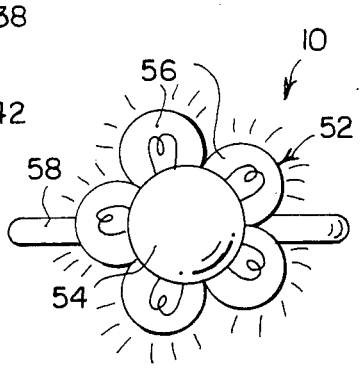
FIG. 3 is a top elevational view of the invention as a ring.
Figure 6:
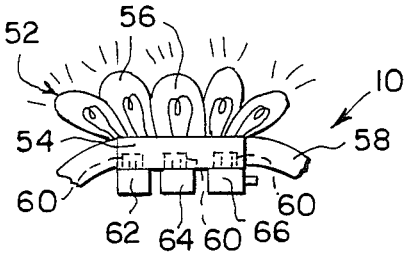
FIG. 6 is a side view of the invention in FIG. 3 with parts broken away showing the flasher, battery and switch plugged into receptacles in rear of the collet.

FIGS. 3 and 6 illustrate the piece of disco jewelry 10 in the form of a ring 52 consisting of a collet 54 that has a plurality of flower pedal-like lamp members 56 thereon electrically connected to each other. A band 58 is connected at its distal ends to the collet 54 so as to be worn on a finger (not shown).

Three receptacles 60 arranged into rear of the collet 54 are electrically connected to the lamp members 56. A flasher 62, a battery 64 and a switch 66 each electrically plugs into one of the receptacles 60 so that when circuit is made complete and the switch 66 is turned on the disco jewelry 10 will illuminate intermittently.

The flashers 26, 46 and 62 can be eliniated while the lamp members 14, 42 and 56 can be of a flasher type, like used in Christmas lights. In this fashion the lamp members will flash randomly or in a flashing sequence pattern instead of all flashing on and off at the same time.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A piece of intermittent illuminated disco jewelry in the form of a necklace/bracelet which comprises:

(a) a plurality of bead-like lamp members;

(b) an elonaged first wire strung through all of said bead-like lamp members to electrically connect each of said bead-like lamp members together;

(c) a pair of sockets, each of said sockets located on a distal end of said elongated first wire;

(d) three bead-like receptacles;

(e) a short second wire strung through all of said bead-like receptacles to electrically connect each of said bead-like receptacles together;

(f) a pair of jacks, each of said jacks located on a distal end of said short second wire to electrically mate with one of said sockets on said elongated first wire;

(g) a flasher which electrically plugs into said first bead-like receptacle;

(h) a battery which electrically plugs into said second bead-like receptacle; and (i) a switch which electrically plugs into said third bead-like receptacle so that when circuit is made complete and said switch turned on, said disco jewelry will illuminate intermittently.

2. A piece of intermittent illuminated disco jewelry as recited in claim 1, wherein each of said bead-like receptacles is split in two halfs with a hinge therebetween so that when said flasher, said battery, said switch is electrically plugged into said respective receptacle in one of the two halfs the other half can be closed over for concealment.

3. A piece of intermittent illuminated disco jewelry in the form of an earring/pendant which comprises:

(a) an ornamented face having a plurality of flower pedal-like lamp members thereon electrically connected to each other;

(b) three receptacles arranged into rear of said ornamented face electrically connected to said lamp members;

(c) a flasher which electrically plugs into said first receptacle;

(d) a battery which electrically plugs into said second receptacle; and (e) a switch which electrically plugs into said third receptacle so that when circuit is made complete and said switch turned on, said disco jewelry will illuminate intermittently.

4. A piece of intermittent illuminated disco jewelry in the form of a ring which comprises:

(a) a collet having a plurality of flower pedal-like lamp members thereon electrically connected to each other:

(b) a band connected at its distal ends to said collet so as to be worn on a finger;

(c) three receptacles arranged into rear of said collet electrically connected to said lamp members;

(d) a flasher which electrically plugs into said first receptacle;

(e) a battery which electrically plugs into said second receptacle; and (f) a switch which electrically plugs into said third receptacle so that when circuit is made complete and said switch turned on said disco jewelry will illuminate intermittently.

* * * * *